US010704264B2

(12) United States Patent
Atchley

(10) Patent No.: US 10,704,264 B2
(45) **Date of Patent: *Jul. 7, 2020**

(54) ROOF RIDGE COVER

(71) Applicant: KWIK RIDGE, INC., Yorba Linda, CA (US)

(72) Inventor: Mitch Atchley, Yorba Linda, CA (US)

(73) Assignee: Kwik Ridge, Inc., Yorba Linda, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/966,692

(22) Filed: Apr. 30, 2018

(65) Prior Publication Data

US 2019/0127982 A1 May 2, 2019

Related U.S. Application Data

(63) Continuation of application No. 14/949,698, filed on Nov. 23, 2015, now Pat. No. 9,957,716, which is a continuation of application No. 13/660,926, filed on Oct. 25, 2012, now Pat. No. 9,194,127.

(60) Provisional application No. 61/552,084, filed on Oct. 27, 2011.

(51) Int. Cl.

| | |
|---|---|
| ***E04D 1/30*** | (2006.01) |
| ***E04D 1/34*** | (2006.01) |
| ***E04D 13/17*** | (2006.01) |
| ***E04D 1/26*** | (2006.01) |
| *E04D 1/00* | (2006.01) |

(52) U.S. Cl.

CPC ..... *E04D 1/30* (2013.01); *E04D 1/265* (2013.01); *E04D 1/3402* (2013.01); *E04D 13/174* (2013.01); *E04D 2001/005* (2013.01); *E04D 2001/305* (2013.01)

(58) Field of Classification Search

CPC ... E04D 1/30; E04D 1/3402; E04D 2001/305; E04D 3/362; E04D 13/174; F24F 7/02

See application file for complete search history.

(56) References Cited

U.S. PATENT DOCUMENTS

| | | | | |
|---|---|---|---|---|
| 1,415,923 A * | 5/1922 | Crabbs | ..... | E04D 1/26 52/558 |
| 1,470,054 A | 10/1923 | Broughton | | |
| 1,653,847 A | 12/1927 | Greenstreet | | |
| 1,861,998 A | 6/1932 | Bennett | | |
| 1,963,583 A | 6/1934 | Jenkins | | |
| 2,160,642 A | 5/1939 | Bumpas et al. | | |
| 2,230,922 A * | 2/1941 | Frank | ..... | E04D 1/30 52/276 |

(Continued)

FOREIGN PATENT DOCUMENTS

JP 06026156 A * 2/1994

*Primary Examiner* — Ryan D Kwiecinski
(74) *Attorney, Agent, or Firm* — R. Reams Goodloe, Jr.

(57) ABSTRACT

An improved roof ridge cover. The roof ridge cover is formed to give the visual appearance of multiple shingles. The edges of the roof ridge cover wrap around existing roof shingles. The cover is stone coated to provide similar appearance to the adjacent roof shingle surfaces. Optional venting material may be used under the cover to allow air to vent from the attic thereby allowing the attic to breathe, although the vent material is sufficiently dense to prevent insects and bugs from passing through the vent material.

20 Claims, 4 Drawing Sheets

(56) References Cited

U.S. PATENT DOCUMENTS 2,255,247 A * 9/1941 Gabriel ..... E04D 1/30 52/278
2,360,052 A * 10/1944 Fuller ..... E04F 19/024 52/276
2,386,338 A * 10/1945 Norrid ..... E04F 19/024 52/276
2,725,832 A 12/1955 Huntington
3,073,235 A 1/1963 Smith et al.
3,114,218 A 12/1963 MacQuere
3,164,929 A * 1/1965 Boddie ..... E04D 3/362 52/409
3,731,438 A 5/1973 Kough
3,760,546 A 9/1973 Martin et al.
3,953,946 A 5/1976 Peters et al.
4,015,374 A * 4/1977 Epstein ..... E04D 1/36 52/57
4,015,391 A 4/1977 Epstein et al.
4,024,685 A 5/1977 Aarons
4,322,924 A 4/1982 Cooper
4,400,217 A * 8/1983 Kober ..... C04B 18/28 106/611
4,554,862 A 11/1985 Wolfert
4,676,147 A * 6/1987 Mankowski ..... F24F 7/02 454/365
4,685,265 A 8/1987 Cooper
4,788,801 A 12/1988 Jones
5,295,340 A * 3/1994 Collins ..... E04D 1/30 52/276
5,304,095 A * 4/1994 Morris ..... F24F 7/02 454/365
5,352,154 A * 10/1994 Rotter ..... E04D 1/36 454/365
5,469,680 A * 11/1995 Hunt ..... E04D 1/18 52/520
5,561,953 A * 10/1996 Rotter ..... E04D 3/30 454/365
5,613,337 A * 3/1997 Plath ..... E04D 1/18 52/533
5,636,490 A 6/1997 Stocksieker
5,881,501 A 3/1999 Guffey
D415,848 S 10/1999 Plath et al.
6,351,913 B1 * 3/2002 Freiborg ..... E04D 1/30 52/276
RE38,210 E 8/2003 Plath et al.
6,725,609 B2 4/2004 Freiborg et al.
7,108,495 B2 9/2006 Gilbert et al.
7,422,520 B2 9/2008 Coulton et al.
8,245,482 B2 * 8/2012 Grubka ..... E04D 1/20 454/365
8,572,921 B2 11/2013 Ward et al.
9,194,127 B2 11/2015 Atchley
9,957,716 B2 5/2018 Atchley
2001/0032421 A1 * 10/2001 Rotter ..... E04D 13/174 52/198
2002/0095882 A1 7/2002 Rotter
2004/0206012 A1 * 10/2004 Pressutti ..... E04D 1/30 52/57
2005/0055902 A1 * 3/2005 Pressutti ..... E04D 1/26 52/198
2010/0218433 A1 * 9/2010 Quaranta ..... E04D 1/30 52/57
2010/0275542 A1 11/2010 Ward et al.
2011/0126485 A1 * 6/2011 Bleil ..... E04D 1/20 52/528
2011/0214378 A1 * 9/2011 Grubka ..... E04D 1/30 52/553
2012/0096782 A1 * 4/2012 Railkar ..... E04D 13/174 52/198
2013/0042540 A1 * 2/2013 Atchley ..... E04D 13/174 52/57
2014/0202093 A1 7/2014 Knighton
2016/0076251 A1 3/2016 Atchley

* cited by examiner

ROOF RIDGE COVER

RELATED PATENT APPLICATIONS

This application is a continuation of and claims priority under 35 USC § 120 from prior and now U.S. patent application Ser. No. 14/949,698, filed Nov. 23, 2015 (to be issued on May 1, 2018 as U.S. Pat. No. 9,957,716 B2), which application is a continuation of and claimed priority under 35 USC § 120 of prior U.S. patent application Ser. No. 13/660,926 filed Oct. 25, 2012, (now U.S. Pat. No. 9,194,127 B2 issued on Nov. 24, 2015), entitled ROOF RIDGE COVER, which application claimed priority under 35 USC. § 119(e) from U.S. provisional patent application Ser. No. 61/552,084 filed Oct. 27, 2011, the disclosures of each are incorporated herein in their entirety, including the specification, drawing, and claims, by this reference.

STATEMENT OF GOVERNMENT INTEREST

Not Applicable.

COPYRIGHT RIGHTS IN THE DRAWING

A portion of the disclosure of this patent document contains material that is subject to copyright protection. The patent owner has no objection to the facsimile reproduction by anyone of the patent document or the patent disclosure, as it appears in the Patent and Trademark Office patent file or records, but otherwise reserves all copyright rights whatsoever.

TECHNICAL FIELD

This disclosure relates to improvements for ridge covers for a roof.

BACKGROUND

The ridge of a roof is one area of a roof that can deteriorate the fastest. This area of a roof is usually subjected to the full sunlight, rain and wind. All of these factors can significantly shorten the life of the ridge cap. A typical ridge cap is fabricated from several layers of roofing felt that are bonded together and then covered with small sand, stones or gravel. The ridge cap area is one of the first parts of a roof from which water can enter into a house. Installing or replacing the ridge cap with a metal cap with prior art devices often results in a significantly different appearance from the surrounding roof material. Some solutions have been to install individual bent shingles resulting in the existence of openings around each shingle and significant labor to install the ridge cover. Several products have been developed and patents have been filed and issued on products that try to solve this problem. Exemplary examples of prior art patents covering such products are disclosed below.

U.S. Pat. No. 6,725,609, issued on Apr. 27, 2004 to Mark Freiborg et al. (and U.S. Pat. App. Pub. No. 2010/0275542) both disclose ridge or hip covers that simulate a single shingle. They are both formed from a flat blank that is formed along the edges and then bent in the middle to simulate the ridge or hip. Because of the simple bends provided the parts can be slightly re-bent to accommodate varied angular ridges or hips. The part described in these documents is not metal and therefore not painted, and thus does not have rust protection. These parts are then simply rust protected and or painted to match the color of the roof without any additional coatings. The parts described in these documents only cover a single shingle, have limited wrap to cover existing shingles. Further, such parts are embedded in the mat with asphalt and are not coated to simulate stone coated shingles.

U.S. Pat. App Publication Number 2006/0154597 was published on Jul. 13, 2006 and issued as U.S. Pat. No. 7,422,520 on Sep. 9, 2008 to Michael S. Coulton et al., discloses an integrated vent that is bonded or captured under the top shingle material. The vent material extends essentially across the full width of the shingle where it can interfere with material or obstructions that extend from the base roof or ridge. The device disclosed in this patent does not allow for coverage over shingled roofs where the roof ridge is stepped. Further, that patent does not disclose a stepped shingle or shingles. The disclosure of that patent further requires the rolled material to be covered in the field when it is being installed.

U.S. Pat. No. 4,015,374 issued on Apr. 5, 1977 to George Epstein et al., discloses an angled cap member for simulated cedar shake construction. The cap member is formed from a flat sheet of material and requires an elevated spacer that raises the cap member above the roof. The cap member is then screwed or bonded to the elevated member. The flat sheet of metal material is embossed to form simulated grain. This patent does not disclose the use of sand, stone or gravel to simulate a shingle roof. Also, the cap member disclosed does not have rounded reliefs that allow the cap to wrap around existing shingles.

U.S. Pat. No. 7,108,495 issued on. Sep. 19, 2006 to Thomas Gilbert et al., discloses an apparatus for continuous forming shaped polymeric articles. The polymeric articles simulate the appearance of shake shingles arranged in rows. After the polymeric articles are formed they are surface treated to improve the wearability of the surface. The disclosure of this patent is directed to a method for creating a particular appearance of shingles. The appearance is not stone coated nor is it useful for the roof ridge over shingles.

It would be desirable to provide a formed ridge cap where the cap is formed with sufficient fillets and rounds to prevent ripping of the shingle material. The ridge cap should provide coverage for multiple shingles. Further, it would be desirable that a new formed ridge cap be stone coated to simulate the appearance of a shingle ridge cap. A roof cap with such attributes is disclosed herein below.

SUMMARY

An improved roof ridge cover is provided. More particularly, an elongated formed roof ridge cover is disclosed. The roof ridge cover extends longitudinally to covers multiple existing roof ridge shingles. This makes installation more efficient. While the ridge cover provides coverage for a plurality of shingles, it also wraps at least partially around the shingles to prevent leakage. In an embodiment, the ridge cover is formed from a metal base that is stone coated to match existing shingles.

Thus, it is an object of this development to provide a roof ridge cover formed to give the appearance of multiple shingles. Fabricating the roof ridge with multiple panels reduces the number of roof ridge covers that must be installed. This provides spacing of roof covers consistent with the spacing of the shingles below, and makes the ridge roof more secure, by reducing the quantity of nails or fasteners that are used to secure the roof covers on the roof ridge. This further provides a significant reduction in the number of locations where water can protrude into the roof of a house or building.

It is an object of this development to provide a roof ridge cover to be fabricated with bend radius using fillets and rounds to ensure that the base material is not stretched beyond the yield point of the material where it can rupture or split. A fine balance must be maintained to ensure that the bends and forming radius both cover any existing shingles while simulating the appearance of shingles. If the ridge cover is too long the length can be cut down or shortened using existing tools that are used by roofing installers.

It is an object of this development to provide a roof ridge cover for the edges of the cover to wrap around any existing roof tiles. The wrapping edges must be sufficient to cover any damaged tiles and provide sufficient clearance of adjacent or abutting ridge covers. The wrap edges must also be short enough to prevent the ridge cover to dig into other shingles or be raised above the surrounding area.

It is an object of this development to provide a roof cover to be configurable for installation on hips, gables and rakes as well as 90 degree "L" shapes. The roof ridge cover is not affected by climate nor have climate restrictions for installation.

It is yet another object of the development to provide a roof ridge cover having a top surface that is stone coated. The stone coating provides an appearance nearly identical to the remainder of the roof surface. The stone coatings provide surface protection, wear resistance and provide a gripping surface for installers or others that may walk on the roof surface.

It is still another object of the development to provide a roof ridge cover available with a vent material that is bonded to the underside of the roof ridge cover. The vent material is sufficiently porous to allow air to vent from the attic thereby allowing the attic to breath, but the vent material must also be sufficiently dense enough to prevent insects and bugs from passing through the vent material. The vent material may be glued, set or otherwise placed as one or two strips along the length of the roof ridge cover, and optionally at the ends of the roof ridge cover to reduce the amount of force that is required to firmly anchor the roof ridge cover onto the roof ridge.

Various objects, features, aspects, and advantages of the apparatus disclosed herein will become more apparent from the following detailed description of preferred embodiments, along with the accompanying drawings in which like numerals represent like components.

BRIEF DESCRIPTION OF THE DRAWING FIGURES

DETAILED DESCRIPTION

Figure 1:
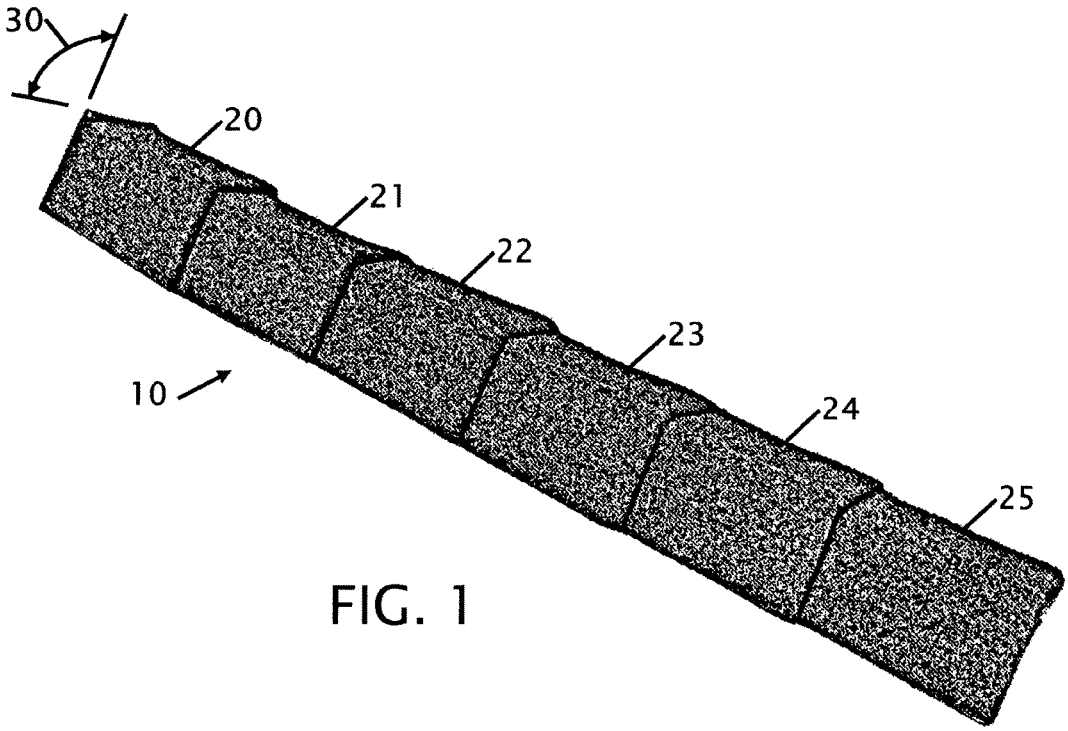
FIG. 1 shows a perspective view of a roof ridge cover.
Figure 2:
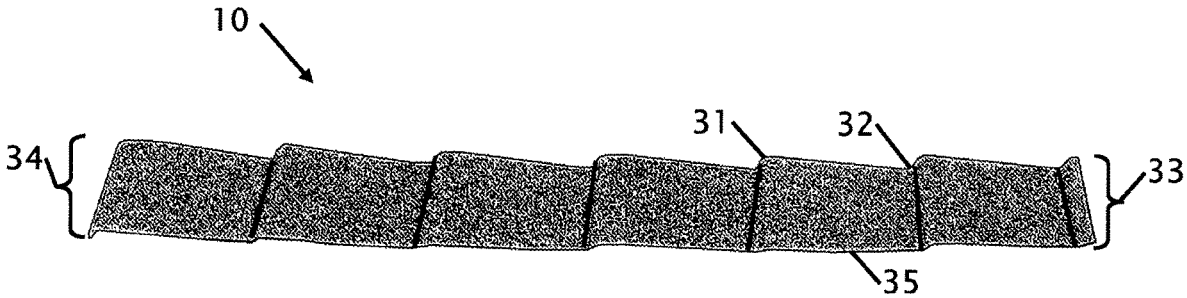
FIG. 2 shows a side view of the roof ridge cover.

FIG. 1 shows a perspective view of a roof ridge cover and FIG. 2 shows a side view of the roof ridge cover 10. The roof ridge cover 10 is fabricated to simulate the appearance of multiple ridge shingles, i.e. shingles 20, 21, 22, 23, 24, and 25. The steps between shingles is normally at about 8 inches, but typically can vary between seven (7) and twelve (12) inches. The preferred embodiment shown in FIG. 1 represents steps between six ridge shingles, namely shingles 20, 21, 22, 23, 24, and 25, with the steps between adjacent ridge shingles. While six levels of ridge shingles are shown it should be understood that as few as two to many more than six levels may be provided in accord with the teaching herein. In the embodiment shown in FIG. 1, six levels are shown because it best accommodates a four foot long blank and allows easy handling by an installer. If the end of the roof ridge cover 10 extends beyond the end of a roof, the roof ridge cover 10 can be trimmed using common roofing tools.

The angle 30 between the two sloped sides of the roof ridge cover 10 is configured to match the angle of a selected roof peak ridge. The angle is between 30 degrees and 120 degrees, but can be other angles. It is also contemplated that the cover is configurable for installation on hips, gables and rakes as well as 30 degree to 90 degree "L" shapes. The fabrication process for a roof ridge cover allows an installer to adjust this angle by nailing down the roof ridge cover 10 or manually distorting the roof ridge cover 10 to fit a complementary angle provided by an existing roof ridge. The coverage of multiple pre-existing roof tiles or shingles minimizes areas where water intrusion can take place. The bends of the roof ridge cover 10 shown as rounds 31 and fillets 32 are designed to simulate the appearance of the underlying tiles and also prevent ripping the material that might cause holes. In the preferred embodiment the rounds 31 and fillets 32 are between 0.12 inch radius and 1.0 inch radius. In addition to the bends that clear the underlying shingles the leading edge 34 and the trailing edge 33 are radiused to wrap around the front and back edges to the roof ridge cover 10. Adjacent roof ridge cover 10 ends 33 and 34 engage upon the turned up edges 33 or turned down edges 34 to make a tight seal. The bottom edge 35 can be configured in a straight embodiment or can further be rounded to wrap around existing ridge tiles to prevent leakage. The dimension(s) of the radiused edges are maintained to prevent damage to flat roof tiles and reduce the elevation of the roof ridge cover 10 above the surrounding roof. Installation of the roof ridge cover 10 on a roof is shown in FIG. 3.

Figure 3:
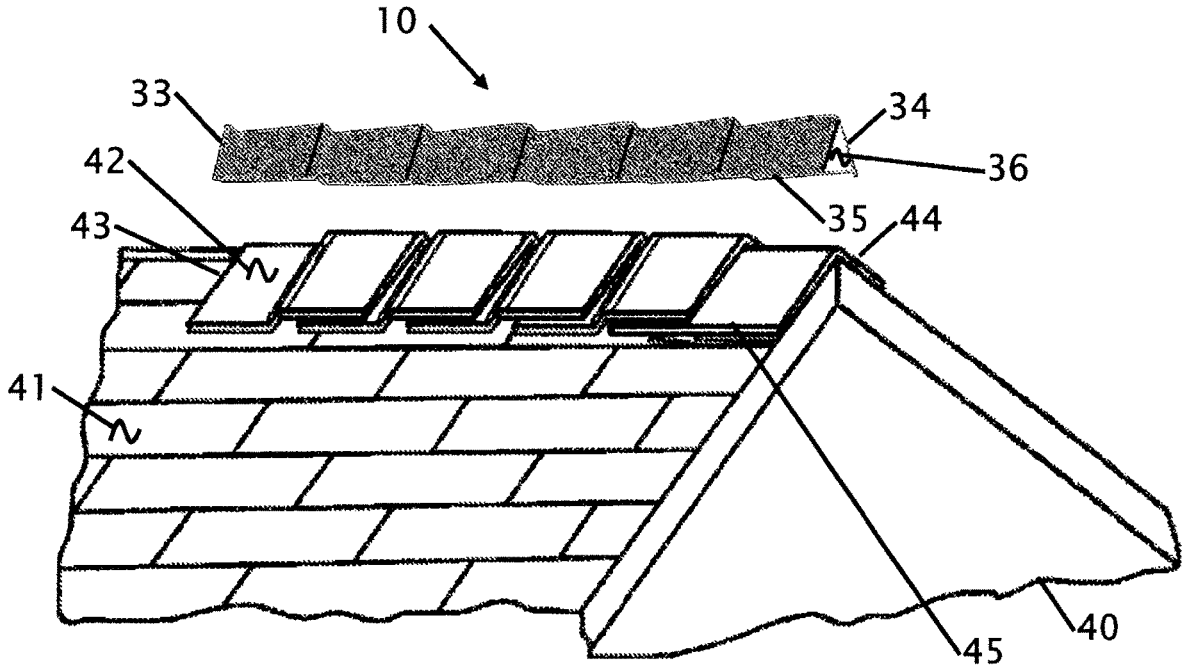
FIG. 3 shows a perspective view of a roof ridge cover positioned over a roof.

FIG. 3 shows a perspective view of a roof ridge cover 10 positioned over a roof. The roof of a house 40 is typically constructed with a peak where the two sloped sides of the roof 41 join. The ridge of the roof is most susceptible to leaks because it often receives the greatest exposure to the elements, e.g., the sun, wind and rain. The roof ridge cover 10 can be installed in newly installed roofs having newly installed shingles, or can be installed over the top of pre-existing roof ridge shingles 42. When the roof ridge cover 10 is installed on a pre-existing roof ridge shingle 42, the under surface 36 contacts the opposing sloped sides of the pre-existing roof ridge shingle 42. The leading edge 34 wraps over and on the sides 43 of the pre-existing roof ridge shingle 42, and of leading edge 44 and side(s) 45 of pre-existing roof ridge shingle 42. The roof ridge cover 10 has a second rounded edge 33 that wraps around at least partially at least one pre-existing roof ridge shingle 42 or sides 43 of existing roof ridge shingle 42 of the existing roof. When the roof ridge cover 10 is installed on the ridge, the leading edge 34 is installed over the outer edge of the ridge to enable water to drop over the edge of the roof. The trailing or upturned edge 33 will be covered by the next roof ridge cover 10. Upon installation of the roof ridge cover 10 the elongated sides of the roof ridge cover 10 are nailed down to prevent the roof ridge cover 10 from being lifted by winds and to retain underlying shingles.

Figure 4:
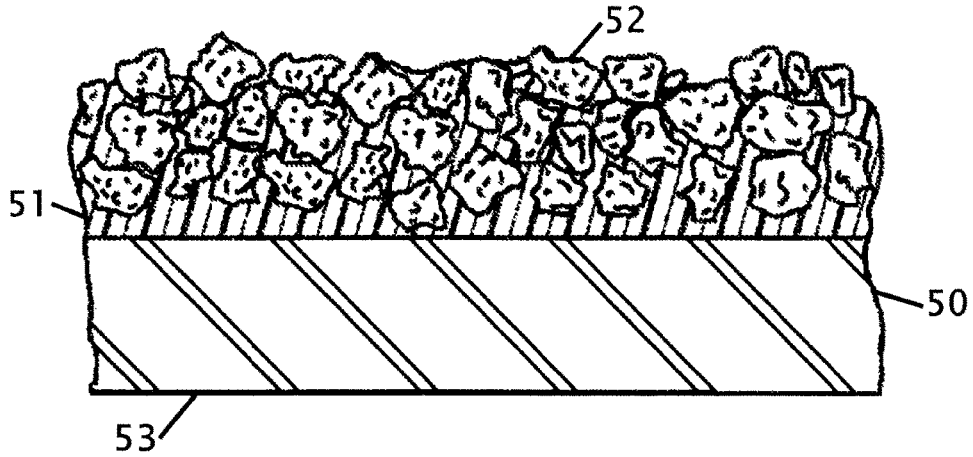
FIG. 4 shows a cross sectional view of the construction of the roof ridge cover.

FIG. 4 shows a cross sectional view of a method for a manufacture of an embodiment for the roof ridge cover. The roof ridge cover is constructed starting a base material, namely base metal 50. In the preferred embodiment the base metal 50 is steel, but other materials, particularly including, but not limited to stainless steel, aluminum, copper or tin may be utilized. The base metal 50 is then formed to simulate shingles. The forming process can take place in a progressive arrangement where each tile structure, elevation or relief is formed individually or collectively. It is also contemplated that the base metal 50 is first bent along its length to form the inverted "V" ridge and then in a secondary or subsequent operation(s) then each tile structure, elevation or relief is formed individually or collectively. While the figures show the cover as an inverted "V" it is also contemplated that the cover may be configures having a shape adapted for installation on hips, gables and rakes as well as 90 degree "L" shapes. A bonding agent 51 may then be applied to the base metal 50 to support a top stone 52 coat that matches the color, density and texture of the roof shingles on the roof of a house or structure. The materials used in the stone coating are typically between the size of sand to pea gravel depending upon the desired appearance and or the appearance of an existing roof material. The bonding agent is typically a nontoxic, non-flammable, re-emulsifying bonding agent that provides a chemical bond between the base material 50 and the top stone(s) 52. A surface treatment of galvanizing 53 or other corrosion prevention can be placed on the base metal 50 prior to applying the top treatments or after the top treatments based upon the manufacturing process. The roof ridge cover 10 is not affected by climate and does not have any climate restrictions for installation.

Figure 5:
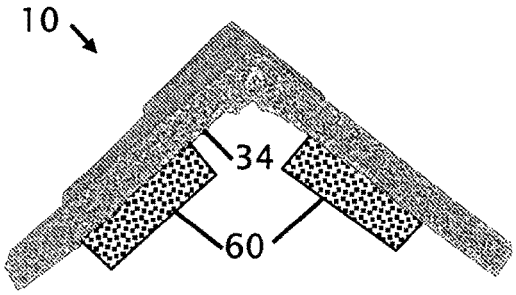
FIG. 5 shows a front view of the roof ridge cover with vent material installed.
Figure 6:
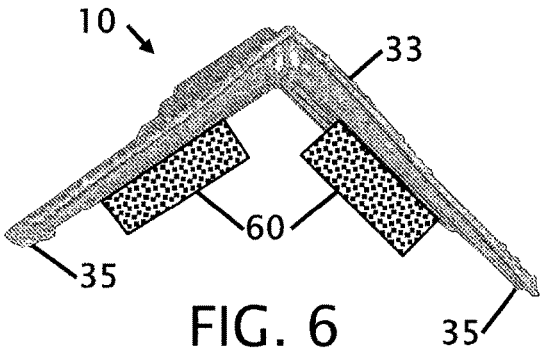
FIG. 6 shows a back view of the roof ridge cover with vent material installed.
Figure 7:
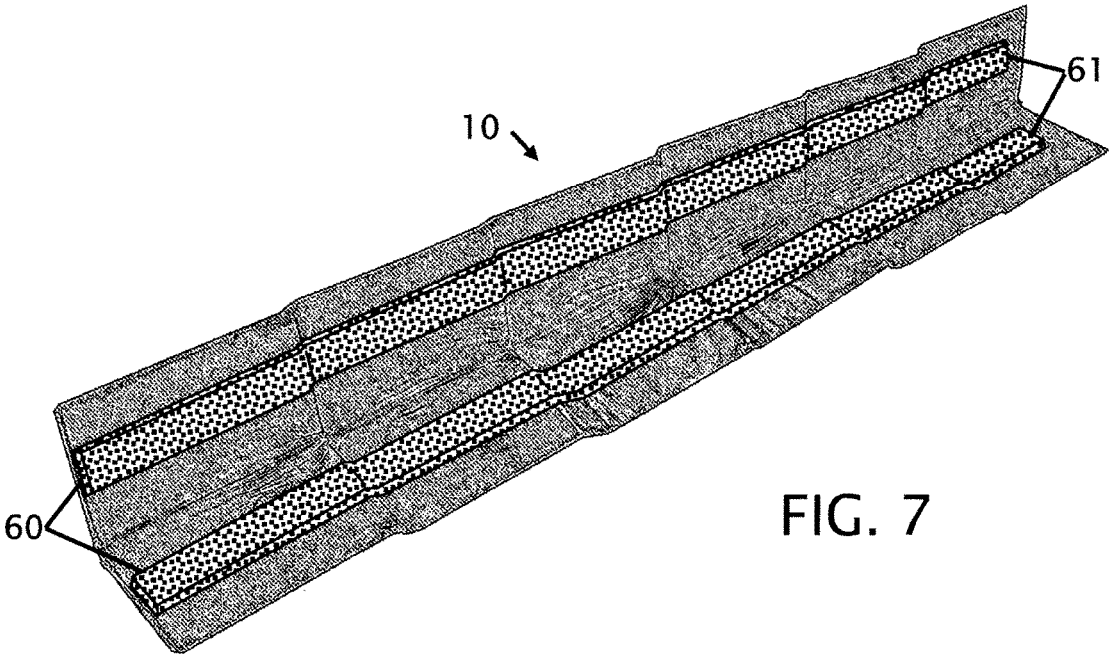
FIG. 7 shows an inside perspective view of the roof ridge cover with vent material installed.

FIG. 5 shows a front view of the roof ridge cover 10 with vent material 60 installed. FIG. 6 shows a back view of the roof ridge cover 10 with vent material 60 installed. FIG. 7 shows an inside perspective view of the roof ridge cover with vent material 60 installed. The roof ridge cover 10 can be constructed with vent material 60. The vent material 60 may be glued, or bonded to the roof ridge cover 10. Or, vent material 60 may simply be placed under the roof ridge cover 10 upon installation of the roof ridge cover 10. As depicted in FIG. 7, the vent material 60 is placed at the front edge of the leading edge 34 of the roof ridge cover 10, while the vent material 60 is set back from the trailing edge 33 to prevent stacking of the vent material 60. The vent material 60 may be installed in elongated strips to minimize interference with other roof features that can exist under the roof ridge cover 10. The density of the vent material 60 allows for the attic to breathe and vent air without allowing bugs and insects to enter the attic. As depicted in FIG. 5 and FIG. 6, the outer edges 35 of the roof ridge cover 10 are slightly curved.

Figure 8:
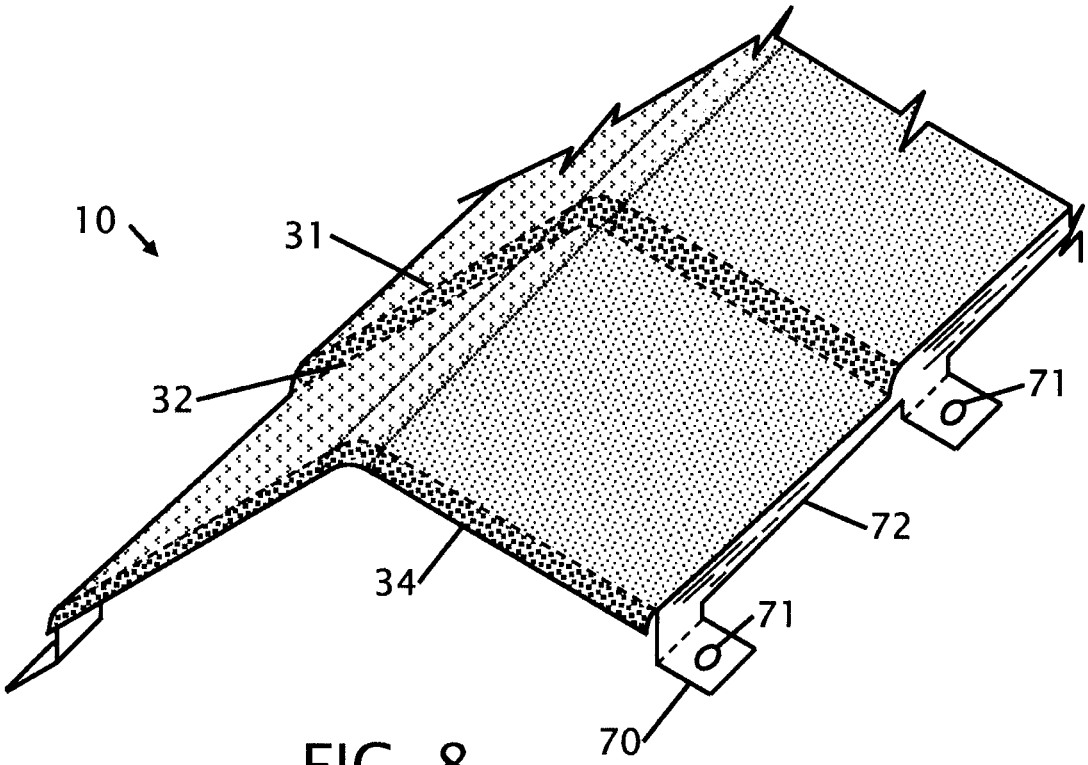
FIG. 8 shows a perspective view of a section of roof ridge cover with tabs for securing the roof ridge cover.

FIG. 8 shows a perspective view of a section of roof ridge cover 10 with tabs for securing the roof ridge cover 10. The front edge 34 is shown bent over to cover an existing shingle or a previously installed roof ridge cover. The rounds 31 and fillets 32 are shown and may be provided at an interval of approximately 8 inches. Nailing tabs 70 are shown with holes 71 or indentations where nails can be placed through the flanges 70. An air gap 72 is constructed into the roof ridge cover 10 to allow for the passage of air from under the roof. When the tabs 70 are included in the roof ridge cover 10 the blank size must be expanded from 12 inches to approximately 14.5 inches.

Thus, specific embodiments of a roof ridge cover have been disclosed. It should be apparent, however, to those skilled in the art that many more modifications besides those described are possible without departing from the inventive concepts herein. The inventive subject matter, therefore, is not to be restricted except as defined by the scope and coverage of the appended claims, and their legal equivalents.

The invention claimed is:

1. A roof ridge cover for use with a roof having opposing sloped sides and between the opposing sloped sides, a roof ridge having an inverted V shape, the roof including a plurality of ridge cover shingles, said plurality of ridge cover shingles including a first ridge cover shingle and a second ridge cover shingle, said roof ridge cover comprising:

an elongated metal base, said elongated metal base having an outer surface and an under surface, said elongated metal base comprising a single blank formed into the shape of at least some of said plurality of ridge cover shingles;

said elongated metal base having an inverted "V" shape;

said elongated metal base configured to include multiple ridge cover shingle portions, by including two or more generally planar shingle surfaces, wherein each of the two or more generally planar shingle surfaces are connected to an adjacent generally planar shingle surface by a bend structure comprising a fillet portion and an outwardly round portion between each of the two or more generally planar shingle surfaces;

said outer surface comprising a cosmetic surface, said cosmetic surface comprising a coating;

said under surface adapted for contact with at least some of said plurality of ridge cover shingles;

said elongated metal base having leading edge sized and shaped to wrap around at least partially at least one of said plurality of ridge cover shingles; and a trailing edge.

2. A roof ridge cover according to claim 1, wherein each of said outwardly round portions have a radius in a range between zero point one two inches (0.12") and one inch (1.0"), inclusive.

3. A roof ridge cover according to claim 1, wherein said leading edge is rounded, so that said leading edge is shaped and sized to cover at least a portion of said second rid e cover shingle of said plurality of ridge cover shingles.

4. A roof ridge cover according to claim 1 wherein said roof ridge cover further includes two elongated sides projecting from a distal edge of said two or more generally planar shingle surfaces formed in the two elongated sides of said elongated metal base, further comprising at least two tabs, said at least two tabs each extending beyond said two or more generally planar shingle surfaces provided in said two elongated sides of the elongated metal base.

5. A roof ridge cover according to claim 1 wherein said elongated metal base is shaped to provide the appearance of multiple ridge cover shingles in said elongated metal base.

6. A roof ridge cover according to claim 5 wherein said multiple ridge cover shingles appearing in said elongated metal base comprise multiple stepped portions, and wherein each of said multiple stepped portions is provided in a length in a range of between seven (7) inches long and twelve (12) inches long.

7. A roof ridge cover according to claim 1, wherein said elongated metal base comprises, on each side of the inverted "V" shape, between four and six generally planar shingle surfaces.

8. A roof ridge cover according to claim 1 wherein said elongated metal base is provided having a width, before formation into said inverted "V" shape, of between twelve (12) inches wide and fourteen point five (14.5) inches wide.

9. A roof ridge cover according to claim 1 wherein said coating on said elongated metal base is corrosion resistant.

10. A roof ridge cover according to claim 1 wherein said coating comprises a nontoxic, non-flammable bonding agent.

11. A roof ridge cover according to claim 1 wherein said coating comprises stone coating.

12. A roof ridge cover according to claim 11 wherein said stone coating comprises sand.

13. A roof ridge cover according to claim 12, wherein said stone coating comprises pea gravel.

14. A roof ridge cover according to claim 1 wherein said elongated metal base comprises steel.

15. A roof ridge cover according to claim 1, wherein said elongated metal base is galvanized.

16. A roof ridge cover according to claim 1 wherein said elongated metal base comprises stainless steel.

17. A roof ridge cover according to claim 1 wherein said elongated metal base comprises aluminum.

18. A roof ridge cover according to claim 1 wherein said elongated metal base comprises tin.

19. A roof ridge cover according to claim 1 wherein said elongated metal base comprises copper.

20. A roof ridge cover for use with a roof having opposing sloped sides between the opposing sloped sides, a roof ridge having an inverted V shape, the roof including a plurality of ridge cover shingles, said plurality of ridge cover shingles including a first ridge cover shingle and a second ridge cover shingle, said roof ridge cover comprising:

an elongated base, said elongated base having an outer surface and an under surface, said elongated base comprising a single blank formed into the shape of said plurality of ridge cover shingles;

said elongated base having an inverted "V" shape;

said elongated base configured to include multiple ridge cover shingle portions, by including two or more generally planar shingle surfaces, wherein each of the two or more generally planar shingle surfaces are connected to an adjacent generally planar shingle surface by a bend structure comprising a fillet portion and an outwardly round portion;

said outer surface comprising a cosmetic surface, said cosmetic surface comprising a coating;

said elongated base having a leading edge, said leading edge adapted to wrap over at least one edge of said plurality of ridge cover shingles; and a trailing edge, said trailing edge shaped to at least partially wrap around said first ridge cover shingle.

* * * * *